US005101384A

United States Patent [19]

Tenghamn et al.

[11] Patent Number: 5,101,384

[45] Date of Patent: Mar. 31, 1992

[54] ACOUSTIC DEVICES

[75] Inventors: Rune Tenghamn; Dag Wikström, both of Västerås, Sweden

[73] Assignee: ABB Atom AB, Västerås, Sweden

[21] Appl. No.: 711,269

[22] Filed: Jun. 4, 1991

Related U.S. Application Data

[63] Continuation of Ser. No. 527,346, May 23, 1990, abandoned.

[30] Foreign Application Priority Data

May 29, 1989 [SE] Sweden ..... 8901905-3

[51] Int. Cl.[5] ..... H04R 17/00

[52] U.S. Cl. ..... 367/165; 367/168; 310/26

[58] Field of Search ..... 367/155, 156, 157, 158, 367/163, 165, 168; 310/26, 337; 381/191; 318/118; 73/DIG. 2

[56] References Cited

U.S. PATENT DOCUMENTS

| | | | |
|---|---|---|---|
| 3,716,828 | 2/1973 | Massa | 367/158 |
| 4,151,437 | 4/1979 | Tocquet | 310/337 |
| 4,384,351 | 5/1983 | Pagliarini, Jr. et al. | 367/168 X |
| 4,901,293 | 2/1990 | Kuhn | 367/168 |
| 4,941,202 | 7/1990 | Upton | 367/165 |

OTHER PUBLICATIONS

Greenlaw et al., "Sonar Transducer Design Incorporates Rare Earth Alloy", in Defense Systems Review, Nov. 1984, pp. 50–55.

*Primary Examiner*—Brian S. Steinberger

*Attorney, Agent, or Firm*—Watson, Cole, Grindle & Watson

[57] ABSTRACT

A driving member for a diaphragm in acoustic devices includes a body with opposite recesses into which driving rods are inserted. One end of the driving rods is attached to pressure rods which directly influence the diaphragm and the other end of the driving rods makes contact with the bottom of the recesses.

7 Claims, 1 Drawing Sheet

ACOUSTIC DEVICES

This application is a continuation of application Ser. No. 527,346, filed May 23, 1990, now abandoned.

TECHNICAL FIELD

The invention relates to means which is particularly applicable to acoustic devices operating with relatively low frequency. Current acoustic devices are able to operate both as transducers, transmitters and receivers of acoustic signals. One field in which an acoustic device according to the invention may be used to great advantage is as a so-called Sonar, that is, a transmitter which sends out sound waves under water, which, after reflection, can be monitored by hydrophones of various kinds. Another field in which the invention may be used is in bass loudspeakers for very high power.

BACKGROUND ART, THE PROBLEM

It is a well-known fact that low-frequency sound waves can travel longer distances through water than can high-frequency sound waves. For a long time there has also been a considerable need of powerful low-frequency sound transmitters which are capable of working under water, both from a military point of view and from the point of view of the offshore oil and gas industry. Such transmitters have also been available on the market for quite a long time. A summary of acoustic transmitters for such purposes is given in an article in DEFENSE SYSTEMS REVIEW, November 1984, pages 50–55 entitled "Sonar transducer design incorporates rare earth alloy".

Most acoustic transmitters which are used at present are based on either the piezoelectric effect or on magnetostriction. As is well-known, the piezoelectric effect means that a crystalline substance is subjected to a change in length when an electric voltage is applied to its end surfaces and that a voltage is obtained across its end surfaces when the substance is subjected to a physical deformation, respectively. The magnetostriction means that a magnetic material which is subjected to a change of the magnetic flux suffers a change in length and that an externally caused change in length gives rise to a change in the magnetic flux, respectively. This means that a transmitter which utilizes these effects can also, in principle, be used as a receiver.

A variety of different embodiments of acoustic transmitters exist. In low-frequency applications it is common that they have a cylindrical shape with either a circular or elliptical cross section area.

The greatest problem with this type of transmitter is to achieve a sufficiently great amplitude of the oscillations. To this end either a large transmitter area or a small transmitter area with great amplitude of oscillation would be required.

The introduction of the so-called giant (rare earth) magnetostrictive materials has improved the conditions for obtaining good acoustic transmitters. With such materials as driving elements in the transmitters, amplitude changes may be obtained which may largely amount to 100 times the corresponding changes using piezoelectric materials or using ordinary magnetic materials. Transmitters which utilize these giant magnetostrictive materials have existed on the market for several years.

A frequently occurring embodiment for the actual driving will be described in greater detail starting from a cylindrical transmitter with an elliptical cross section. The cylindrical envelope surface consists of an elastic diaphragm or shell. Inside and parallel to the axis of the cylinder and making contact with the shell are two rods applying pressure to the shell. The cross section area of the rods is symmetrically mirror-inverted in relation to the minor axis and each rod is delimited by that part of the contour of the ellipse which faces the end of the major axis and a chord parallel to the minor axis. Between the rods and making contact with their plane-parallel sides there is arranged an electrically controlled driving element in the form of a driving rod. The longitudinal axis of the driving rod coincides with the major axis of the elliptically formed cross section and lies midway between the end surfaces of the transmitter. In those case where the magnetostrictive effect is utilized, the driving rod consists of a magnetic material, suitably a giant magnetostrictive material, which with a surrounding winding is magnetized to keep pace with the desired frequency of the transmitter. If the piezoelectric effect is to be utilized, the driving rod is made of a piezoelectric material. The driving rod may, of course, consist in its entirety, or in certain parts, of a material with the desired possibilities of changing the length.

The fundamental embodiment of an acoustic transmitter described above may be different as regards the actual details. An acoustic transmitter with a cylindrical shape and with an elliptical cross section area and with driving rods of a giant magnetostrictive material, is disclosed, inter alia, in International Publication No. WO 86/03888, dated July 3, 1986.

As will have been clear from the above, it is desirable to obtain as great changes in amplitude as possible. The choice of the shape of the elliptical cross section area is therefore of great importance. It is to be noted that the ratio between the major axis and the minor axis of the ellipse is often chosen as 2:1. If a certain change of length of the major axis is obtained with the aid of the driving rod, the change of length of the minor axis will be 2–4 times as great, all according to the properties of the shell and the shape of other parts.

SUMMARY OF THE INVENTION

A device according to the invention makes possible considerably greater amplitudes than what can be achieved with the cylindrical, acoustic transmitters described above. The starting-point is a design as the one described above with an elastic diaphragm or shell and two inner pressure rods at the ends of the major axis. Inside the shell and in the entire axial length of the transmitter there is located a driving member which, inter alia, comprises a body which largely fills up the inner space. This body has sides which are plane-parallel to the pressure rods and has otherwise envelope surfaces which correspond to the elliptical contour of the shell. The body is fixed to the transmitter at its end surfaces and has otherwise a certain distance both to pressure rods and the inner surface of the shell.

An increase of the amplitudes of the transmitter in relation to the described design may take place by providing the driving member, besides with the body, with an arrangement with an electrically controlled driving element comprising several driving rods, suitably of a giant magnetostrictive material. In this way a considerably greater force can be attained between the pressure rods than with the previous designs mentioned. To one of the pressure rods a first driving rod is attached with its longitudinal axis in the direction of the major axis of the ellipse and placed midway between the end surfaces of the transmitter. In parallel with this first driving rod and at equal distances on either side of this rod, two identical driving rods are attached to the second pressure rod, these rods being hereinafter called the second and third driving rods, respectively. This body is provided with recesses, each of them housing a driving rod with a surrounding magnetization device. The axial length of the recesses is adapted such that the body is centered in the transmitter via the driving rods.

The cross section area of each one of the second and third driving rods is to be approximately as great as half the cross section area of the first driving rod. If it is stated that the force which, in case of a certain cross section area, is developed in each one of the second and third driving rods upon a change in length thereof is equal to F, the first middle driver rod, since pressure balance prevails, must develop a force equal to 2F. This also results in largely twice as great a change of length of the major axis of the transmitter cross section, with an ensuing doubling of the corresponding movement of the minor axis, as that obtained with the transmitter described under "Background Art".

Because of the symmetrical design, no torque will influence the transmitter.

The described concept may be developed further in a plurality of different ways. By increasing the cross section area of the driving rods while retaining the cross section ratio between them, the developed force will be increased in the same proportion. The increase in cross section can thus take place by increasing the number of parallel driving rods.

An additional increase in amplitude or length of stroke can be obtained by connecting several driving members according to the above in series.

BRIEF DESCRIPTION OF THE DRAWING

FIGS. 1 and 2 show sections parallel to the end surfaces of the transmitter. FIG. 3 shows a section in the longitudinal direction of the transmitter through the major axis of the elliptical cross section.

DESCRIPTION OF THE PREFERRED EMBODIMENT

Figure 1:
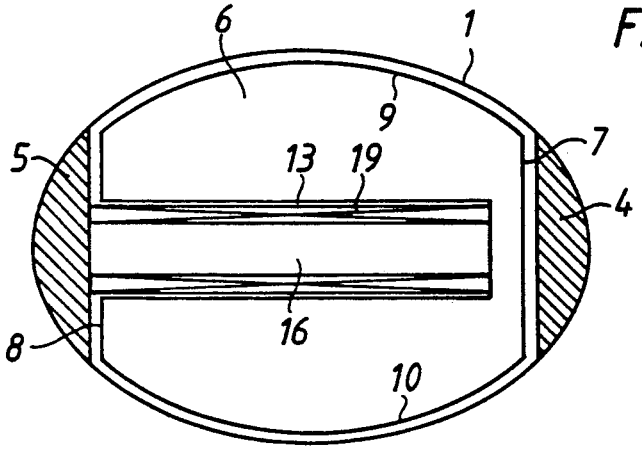
FIGS. 1, 2 and 3 show different sections through an acoustic transmitter of cylindrical shape and with an elliptical cross section area.
Figure 2:
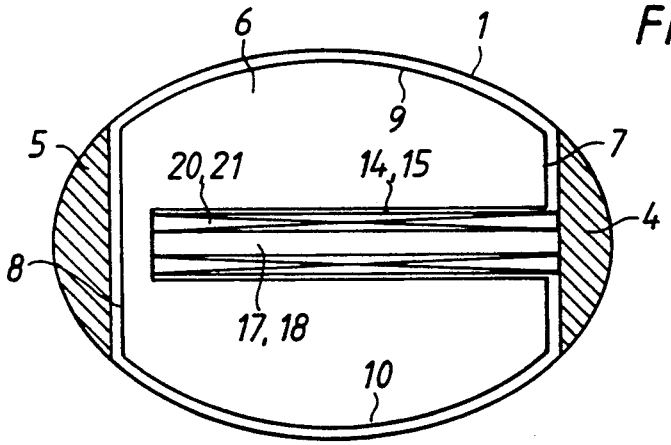
Figure 3:
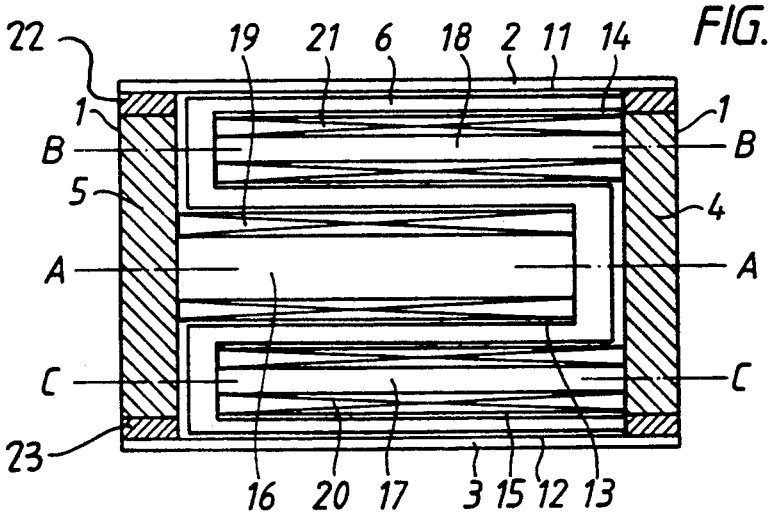

A preferred embodiment of an acoustic transmitter comprising a device according to the invention for obtaining an increased amplitude is shown in the accompanying FIGS. 1, 2 and 3. As will be clear, the transmitter has a cylindrical shape with an elliptical cross section. It has an outer casing in the form of a diaphragm or shell 1 and two elliptical end surfaces 2 and 3. Inside the shell and parallel to the axis of the cylinder there are two pressure rods 4 and 5. As will be clear from the figures, the rods have cross section areas which are symmetrically mirror-inverted relative to the minor axis. Each rod is delimited by that part of the inner contour/envelope surface of the ellipse/shell which faces the end of the major axis and a chord/a plane parallel to the minor axis.

The major part of the inner space remaining in the shell is taken up by the driving member of the transmitter which comprises a body 6 which has the same axial length as the transmitter. It has axial plane-parallel surfaces 7 and 8 against the pressure rods and envelope surfaces 9 and 10 which largely correspond to the elliptical envelope surface of the shell. The body is fixed to the end surfaces of the transducer by suitable means 11 and 12 but has sufficient clearance with respect to pressure rods and shell so that, due to rings 22, 23, the oscillating movement of the shell, when the transmitter is in operation, is not prevented. The body is also provided with three recesses 13, 14 and 15, the location and purpose of which will be explained in greater detail below.

The driving member further comprises driving elements in the form of an a number of driving rods formed or ordinary (soft) magnetic material or giant (rare earth) magnetostrictive material. To one of the pressure rods, 5, there is attached a first driving rod 16 with its longitudinal axis in the direction of the major axis and placed midway between the end surfaces of the transmitter. In parallel with this first driving rod and equally spaced from this on either side thereof, there are attached to the second pressure rod 4 two identical driving rods 17 and 18, called the second and third driving rods, respectively. All of these three driving rods are each surrounded by a device 19, 20 and 21 for magnetization. The recesses in the above-mentioned body 6 are so adapted as regards location and dimensions that the driving rods with the surrounding excitation devices have radial clearance with respect to the body. However, the axial length of the recesses is adapted such that the body is centered in the transmitter by way of the driving rods.

As stated under the "Summary of the Invention", alternative embodiments with several driving rods may well be used. In the same way, several driving members can be connected in series to obtain a greater amplitude/length of stroke.

The device which permits increased amplitude/-length of stroke may advantageously be used also with transmitters of other cross sections than elliptical, for example circular, and also when driving rods other than giant magnetostrictive driving rods, for example piezoelectric driving rods, are part of the transmitter.

In a preferred embodiment the driving rods have a circular cross section area but they may, of course, also have other shapes.

The pressure rods which are used in the embodiment described above for transmitting the movement of the driving member to the diaphragm may, of course, be formed in several different ways, for example more or less integrated into the diaphragm, or as shown in the above-mentioned International Publication No. WO 86/03888.

The driving member described may also be used to advantage in other types of acoustic transmitters, for example in so-called piston transmitters, loudspeakers, etc. Depending on the application in question, certain connection of the driving member to the diaphragm in question may in such cases be required.

The device according to the invention may be used when other than electrically controlled driving elements, for example hydraulically or pneumatically, etc., controlled driving elements, are part of the transmitter.

We claim:

1. An acoustic transducer which comprises:

and elastic tubular shell which has opposite end surfaces and defines an axial direction, first and second opposed pressure rods which extend axially within said tubular shell and between said opposite end surfaces, said pressure rods defining flat facing interior surfaces, a driving body centrally positioned with said shell and mounted between said first and second opposite end surfaces, said driving body defining respective flat surfaces which face said flat interior surfaces of said first and second pressure rods, said driving body providing at least one recess in each of said flat surfaces thereof which extends in parallel with said opposite end surfaces of said tubular shell, said recesses being alternatingly axially displaced relative to one another, and driving rods which extend from said pressure rods into respective recesses in said driving body, said driving rods having equal cross sections.

2. An acoustic transmitter according to claim 1, wherein one driving rod is attached to one pressure rod and wherein two driving rods are attached to the other pressure rod.

3. An acoustic transmitter according to claim 1, wherein the tubular shell has an elliptical cross section area.

4. An acoustic transmitter according to claim 1, wherein the driving rods are formed of a rare earth magnetostrictive material.

5. An acoustic transmitter according to claim 1, wherein the driving rods are formed of soft magnetic material.

6. An acoustic transmitter according to claim 1, wherein the driving rods are formed of a piezo-electric material.

7. An acoustic transmitter according to claim 1, including means for magnetization of the driving rods made of magnetic material.

* * * * *